US010606195B2

(12) United States Patent
Nakajima et al.

(10) Patent No.: US 10,606,195 B2
(45) Date of Patent: Mar. 31, 2020

(54) IMAGE FORMING APPARATUS HAVING A CONVEYANCE WITH AIR CIRCULATING OPENING

(71) Applicant: CANON KABUSHIKI KAISHA, Tokyo (JP)

(72) Inventors: Keita Nakajima, Mishima (JP); Kenji Abe, Mishima (JP); Tomonari Inoue, Eagle, ID (US); Takehito Osada, Susono (JP); Ko Katahira, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/357,470

(22) Filed: Mar. 19, 2019

(65) Prior Publication Data

US 2019/0302660 A1 Oct. 3, 2019

(30) Foreign Application Priority Data

Mar. 27, 2018 (JP) ..... 2018-060697

(51) Int. Cl.
*G03G 15/20* (2006.01)
*G03G 21/18* (2006.01)

(52) U.S. Cl.
CPC ..... *G03G 15/2028* (2013.01); *G03G 21/1803* (2013.01); *G03G 21/185* (2013.01)

(58) Field of Classification Search
CPC ..... G03G 15/2017; G03G 15/2021; G03G 15/2028; G03G 15/6573; G03G 15/6582
USPC ..... 399/92, 322, 341
See application file for complete search history.

(56) References Cited

U.S. PATENT DOCUMENTS

| | | | | |
|---|---|---|---|---|
| 8,340,563 | B2 | 12/2012 | Nakajima et al. | |
| 8,807,559 | B2 | 8/2014 | Osada et al. | |
| 8,903,265 | B2 * | 12/2014 | Kubo | G03G 15/2028 399/92 |
| 9,102,483 | B2 | 8/2015 | Osada et al. | |
| 9,383,692 | B2 * | 7/2016 | Ueno et al. | G03G 15/2017 |
| 9,535,399 | B2 * | 1/2017 | Wakimoto | G03G 15/2017 |
| 9,718,633 | B2 | 8/2017 | Osada | |

(Continued)

FOREIGN PATENT DOCUMENTS

| | | |
|---|---|---|
| JP | 2003-026353 A | 1/2003 |
| JP | 2003-084514 A | 3/2003 |

(Continued)

*Primary Examiner* — William J Royer
(74) *Attorney, Agent, or Firm* — Venable LLP

(57) ABSTRACT

A toner image is formed on a first sheet surface and then heated. A conveyance unit includes a first rotary member configured to contact the first sheet surface and a second rotary member configured to contact a second sheet surface opposite to the first sheet surface. A conveyance guide is provided with an opening through which air is blown to the first sheet surface. The conveyance guide includes a first surface part and a second surface part. The first surface part is disposed on a location in a width direction overlapping with a location in the width direction of the first rotary member. In at least a part of a range between the opening and the first rotary member in the sheet conveyance direction, the first surface part is protruded with respect to the second surface part in a height direction.

13 Claims, 13 Drawing Sheets

(56) References Cited

U.S. PATENT DOCUMENTS

| | | | |
|---|---|---|---|
| 10,040,657 | B2 | 8/2018 | Osada |
| 2018/0208419 | A1 | 7/2018 | Mizuta et al. |

FOREIGN PATENT DOCUMENTS

| | | | |
|---|---|---|---|
| JP | 2010-266798 | A | 11/2010 |
| JP | 2017-156765 | A | 9/2017 |

* cited by examiner

A–A

A–A

IMAGE FORMING APPARATUS HAVING A CONVEYANCE WITH AIR CIRCULATING OPENING

BACKGROUND OF THE INVENTION

Field of the Invention

The present invention relates to an image forming apparatus which forms images on sheets.

Description of the Related Art

In electrophotographic image forming apparatuses, heat fixing is performed. In the heat fixing, a toner image, which has been formed on an image bearing member such as a photosensitive drum and then transferred onto a sheet, is heated to melt toner particles and fixed to the sheet as the toner solidifies and adheres to the sheet. It is known that the gloss level of images varies depending on cooling process of the melted toner. For example, when a cold roller comes in contact with a hot toner image, a difference in gloss level may occur between one part of the toner image which the roller has contacted and the remaining part of the toner image which the roller has not contacted. The difference in gloss level may cause visible unevenness in gloss, which is also called a roller mark.

In Japanese Patent Application Publication No. 2010-266798, a conveyance guide is provided between a fixing apparatus and conveyance rollers disposed downstream of the fixing apparatus and used to convey sheets, and air outlets are formed in the conveyance guide to blow air to the sheets. The air outlets are disposed in a width direction of the sheets, at positions corresponding to the conveyance rollers. In this configuration, areas of each sheet which will contact the conveyance rollers are targeted and cooled to suppress the difference in temperature between the conveyance rollers and a toner image, to reduce the roller mark.

However, when the configuration of Japanese Patent Application Publication No. 2010-266798 is used, the cooling air from the air outlets, which blows on the sheet and flows in a sheet conveyance direction, will cool the conveyance rollers. As a result, the difference in temperature between the toner on the areas of the sheet which is reaching the conveyance rollers and the outer circumferential surfaces of the conveyance rollers may become large, causing the roller mark on an outputted image.

SUMMARY OF THE INVENTION

According to one aspect of the invention, an image forming apparatus includes: a toner image forming portion configured to form a toner image on a sheet; a heating unit configured to heat the toner image that is formed on the sheet by the toner image forming portion; a conveyance unit configured to convey the sheet with the toner image that is formed on a first sheet surface of the sheet by the toner image forming portion and is heated by the heating unit, the conveyance unit including a first rotary member configured to contact the first sheet surface of the sheet and a second rotary member configured to contact a second sheet surface of the sheet opposite to the first sheet surface; a conveyance guide configured to face the first sheet surface of the sheet and guide the sheet toward the conveyance unit, the conveyance guide being provided with an opening located between the heating unit and the conveyance unit in a sheet conveyance direction; and an air blower configured to blow air to the first sheet surface of the sheet through the opening. The conveyance guide includes a first surface part and a second surface part, the first surface part being disposed on a location in a width direction overlapping with a location in the width direction of the first rotary member, the width direction being perpendicular to the sheet conveyance direction, the second surface part being disposed adjacent to the first surface part in the width direction. In at least a part of a range between the opening and the first rotary member in the sheet conveyance direction, the first surface part is protruded with respect to the second surface part in a height direction, the height direction being a direction along a line drawn from an axis of the first rotary member toward an axis of the second rotary member in a cross section perpendicular to the width direction.

Further features of the present invention will become apparent from the following description of exemplary embodiments with reference to the attached drawings.

DESCRIPTION OF THE EMBODIMENTS

Hereinafter, an image forming apparatus of the present disclosure will be described with reference to the accompanying drawings. The image forming apparatus may be a printer, a copying machine, a facsimile, or a multifunction printer; and forms images on sheets used as a recording medium, in accordance with image information sent from an external computer or read from a document. The sheets used as a recording medium may be paper such as plain paper or thick paper, plastic films used for overhead projectors, specialized shape of sheets such as envelopes or index paper sheets, cloth, etc.

First Embodiment

Figure 1A:
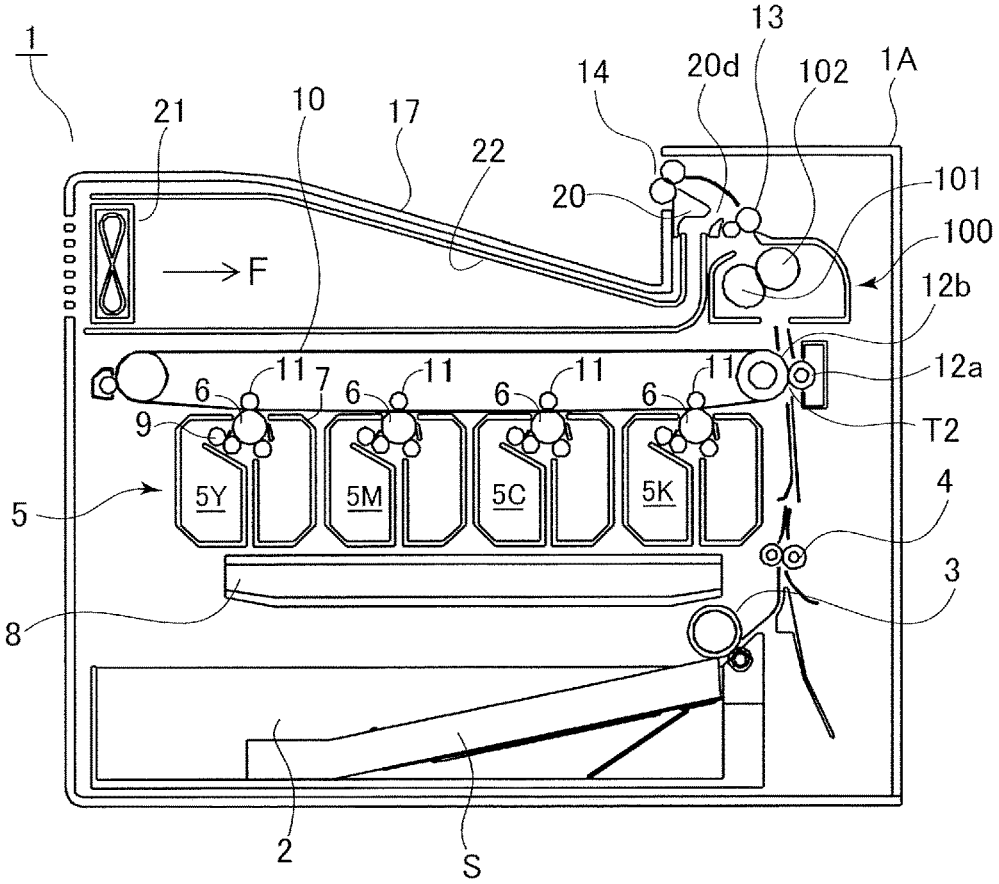
FIG. 1A is a schematic diagram of an image forming apparatus of the present disclosure.
Figure 1B:
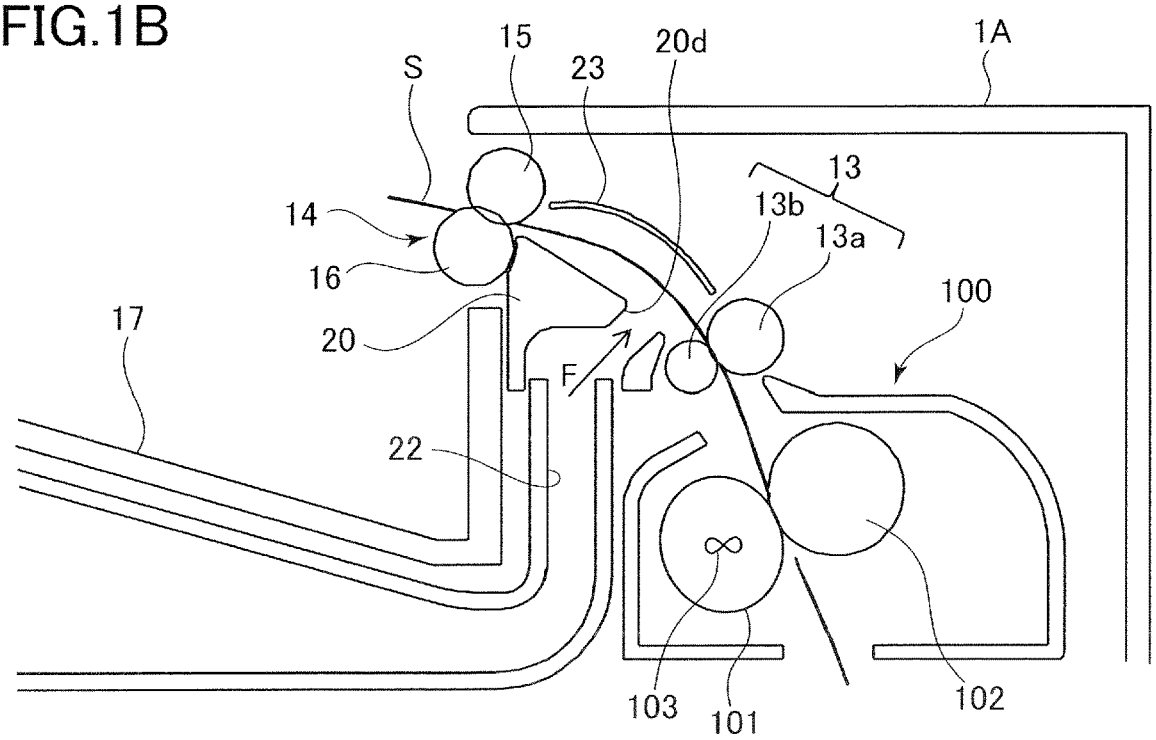
FIG. 1B is a partial enlarged view of FIG. 1A.

An image forming apparatus of a first embodiment will be described with reference to FIGS. 1A to 5. FIG. 1A is a schematic diagram of a full-color laser beam printer (hereinafter referred to as a printer 1) which is an image forming apparatus of the present embodiment. FIG. 1B is an enlarged view illustrating a fixing apparatus 100, a discharging roller pair 14, and their surroundings of the printer 1.

In a lower portion of the printer 1, a cassette 2 is housed so as to be able to be drawn from the printer 1. Sheets S stacked on the cassette 2 are fed, one by one, by a feed roller 3 to a registration roller 4. The registration roller 4 sends the sheet S toward a secondary transfer portion T2 at a synchronized timing with a process of an image forming portion 5 forming a toner image.

The image forming portion 5 of the present embodiment is a tandem-type intermediate transfer electrophotographic unit which includes image forming stations 5Y, 5M, 5C, and 5K, and an intermediate transfer belt 10. The image forming stations 5Y, 5M, 5C, and 5K respectively form toner images of yellow, magenta, cyan, and black. The image forming stations 5Y to 5K are aligned along the intermediate transfer belt 10, which is an intermediate transfer member. Each of the image forming stations 5Y to 5K includes a photosensitive drum 6, which is an image bearing member, a charging apparatus 7, a developing apparatus 9, and a primary transfer roller 11. The photosensitive drum 6 is arranged to be irradiated with a laser beam from a scanner unit 8 disposed below the image forming stations 5Y to 5K.

When a toner-image forming operation is performed, the photosensitive drum 6 rotates, and the charging apparatus 7 uniformly charges the surface of the photosensitive drum 6. The scanner unit 8 irradiates the photosensitive drum 6 with a laser beam, which is modulated in accordance with information on an image to be printed; and thereby forms an electrostatic latent image on the surface of the photosensitive drum 6. The developing apparatus 9 supplies toner to the photosensitive drum 6, and develops the electrostatic latent image into a toner image. The toner image on the photosensitive drum 6 is transferred onto the intermediate transfer belt 10 by the primary transfer roller 11. Similar toner-image forming operations in the image forming stations 5Y to 5K are performed in parallel, and toner images having respective colors are superposed on each other on a surface of the intermediate transfer belt 10, forming a full-color toner image. The toner image on the intermediate transfer belt 10 is transferred onto the sheet S in the secondary transfer portion T2. The secondary transfer portion T2 is formed between a secondary transfer roller 12*a*, which is a transfer member, and a facing roller 12*b*, which faces the secondary transfer roller 12*a*.

The sheet S onto which the toner image has been transferred in the secondary transfer portion T2 is delivered to the fixing apparatus 100, which is a heating unit. As illustrated in FIG. 1B, the fixing apparatus 100 includes a fixing roller 101, a pressure roller 102, and a heat source 103. The fixing roller 101 and the pressure roller 102 are a roller pair, which rotates while nipping the sheet S between the fixing roller 101 and the pressure roller 102. While the sheet S is conveyed by the fixing roller 101 and the pressure roller 102, pressure and heat are applied to the sheet S to melt the toner particles of the toner image. After that, when the temperature of the toner falls, the toner solidifies and adheres to the sheet S, causing the image to be fixed to the sheet S.

The heat source 103 of the fixing apparatus 100 may be a halogen lamp or an induction heating (IH) unit. In addition, one or both of the fixing roller 101 and the pressure roller 102 (which nip the sheet S therebetween) of the roller pair may be replaced with a belt member.

The sheet S sent from the fixing apparatus 100 is conveyed to the discharging roller pair 14 via a decurler roller pair 13. The decurler roller pair 13 includes a soft roller 13*a* and a hard roller 13*b* for reducing curl of the sheet S. The soft roller 13*a* has an outer circumferential surface made of an elastic material such as silicon rubber, and the hard roller 13*b* is made of a material, such as metal, harder than the soft roller 13*a*. The discharging roller pair 14, which is a conveyance unit of the present embodiment, includes an upper roller 15 and a lower roller 16; and discharges the sheet S onto a sheet stacking portion 17 disposed in a top portion of a printer body 1A. When the sheet S is discharged onto the sheet stacking portion 17, the image output on the sheet S is completed.

Here, the toner image forming portion may be replaced with a monochrome electrophotographic unit in which a single photosensitive drum is disposed, and may use a direct-transfer method in which a toner image is directly transferred from a photosensitive drum onto a sheet. In addition, the printer 1 may include a reversing roller pair and a duplex conveyance path to perform duplex printing. In this case, the sheet S having passed through the fixing apparatus 100 is reversed by the reversing roller pair, and is conveyed toward the registration roller 4 again along the duplex conveyance path.

Cooling of Toner Image

Next, a configuration to cool the toner image on the sheet S will be described. As illustrated in FIG. 1A, the printer 1 includes a fan 21, which is an example of an air blower. Air flow (F) generated by the fan 21 is blown, through a duct 22, on a portion of the sheet S between the decurler roller pair 13 and the discharging roller pair 14.

As illustrated in FIG. 1B, a guide member 20 is disposed between the decurler roller pair 13 and the discharging roller pair 14 in the sheet conveyance direction; and air outlets 20*d*, which are openings in the present embodiment, are formed in the guide member 20. The air flow (F) generated by the fan 21 is blown to a first sheet surface of the sheet S, through the air outlets 20*d* which communicate with the duct 22.

The first sheet surface is a surface (printing surface) onto which a toner image is transferred from the intermediate transfer belt 10 in the secondary transfer portion T2. The surface of the sheet S opposite to the first sheet surface is defined as a second sheet surface. In a case where a function of the duplex printing is implemented, the first sheet surface is a surface of the sheet S onto which a toner image has been transferred the last time before the sheet S is discharged by the discharging roller pair 14, and the second sheet surface is a surface of the sheet S opposite to the first sheet surface.

Figure 2A:
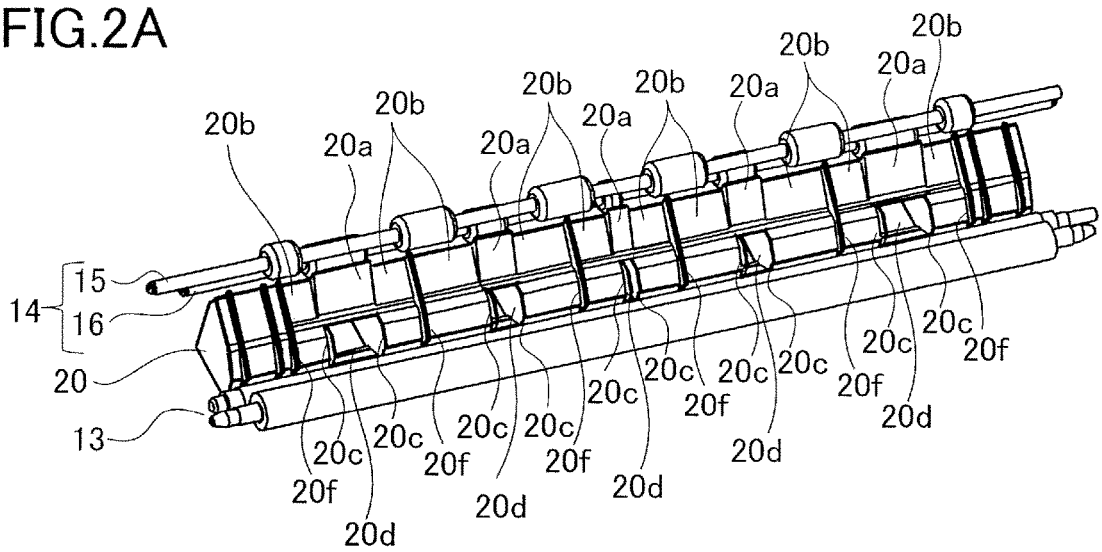
FIG. 2A is a perspective view illustrating a guide member and its surroundings of a first embodiment.
Figure 2B:
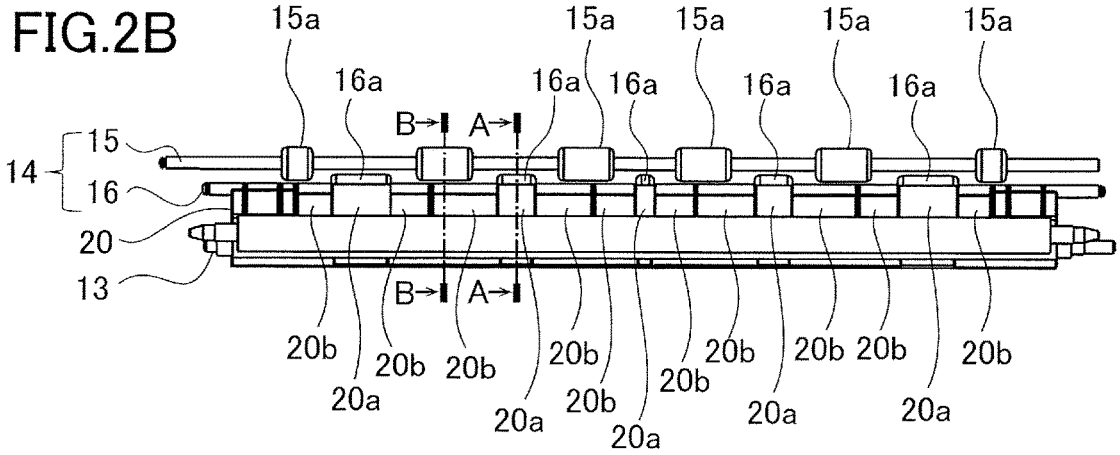
FIG. 2B is a side view illustrating the guide member and its surroundings of the first embodiment.
Figure 2C:
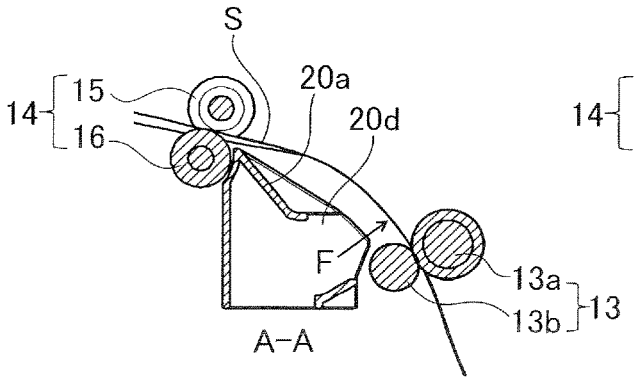
FIG. 2C is a cross-sectional view illustrating the guide member and its surroundings of the first embodiment.
Figure 2D:
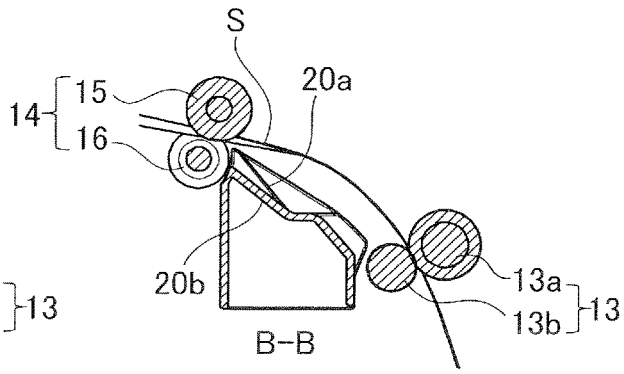
FIG. 2D is a cross-sectional view illustrating the guide member and its surroundings of the first embodiment.
Figure 3A:
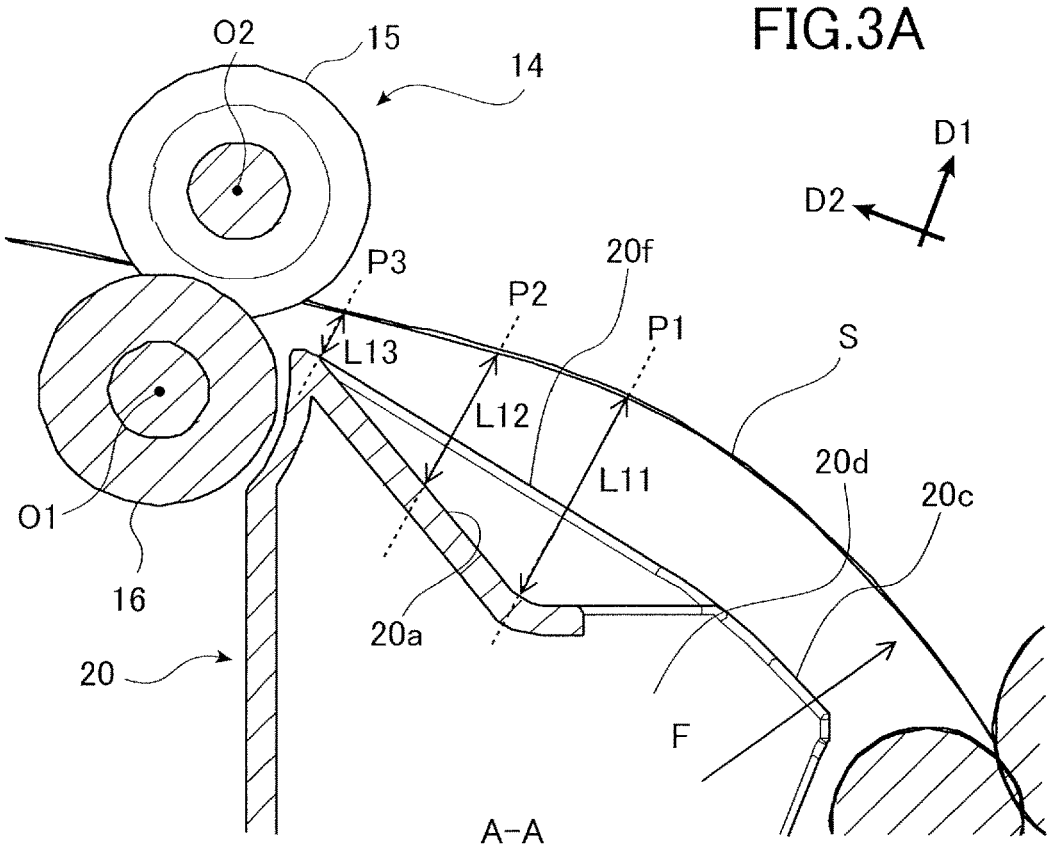
FIG. 3A is an enlarged cross-sectional view illustrating the guide member and its surroundings of the first embodiment.
Figure 3B:
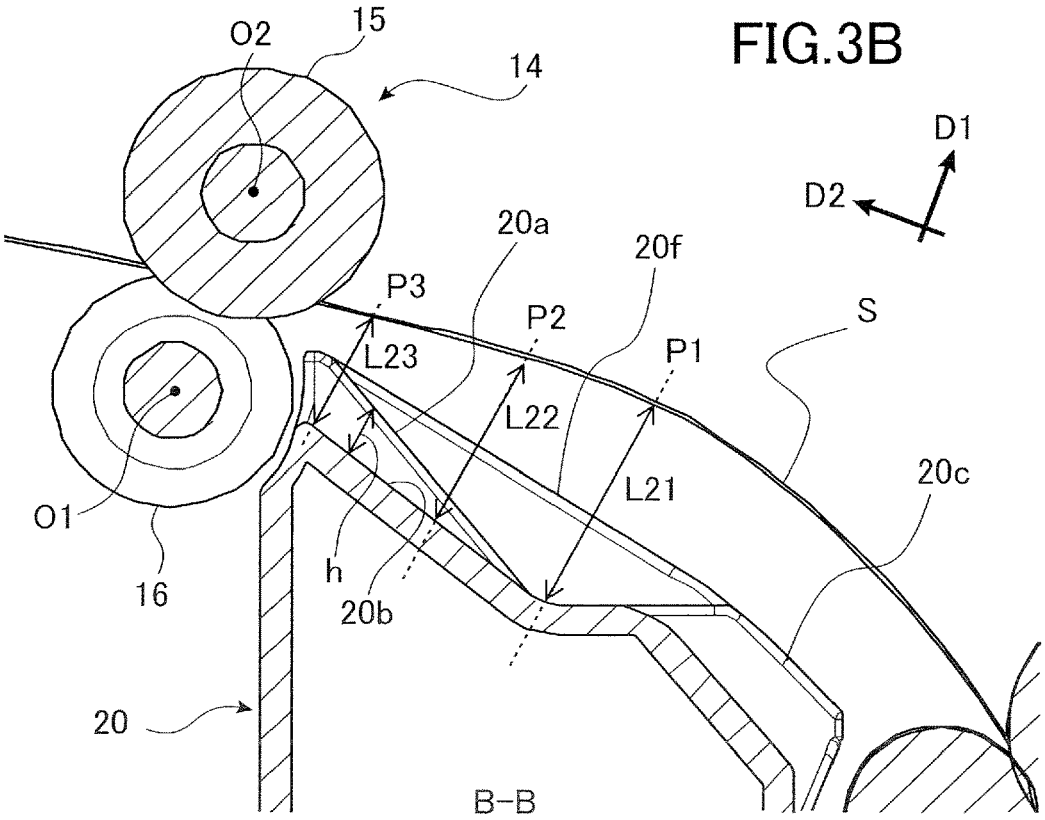
FIG. 3B is an enlarged cross-sectional view illustrating the guide member and its surroundings of the first embodiment
Figure 4:
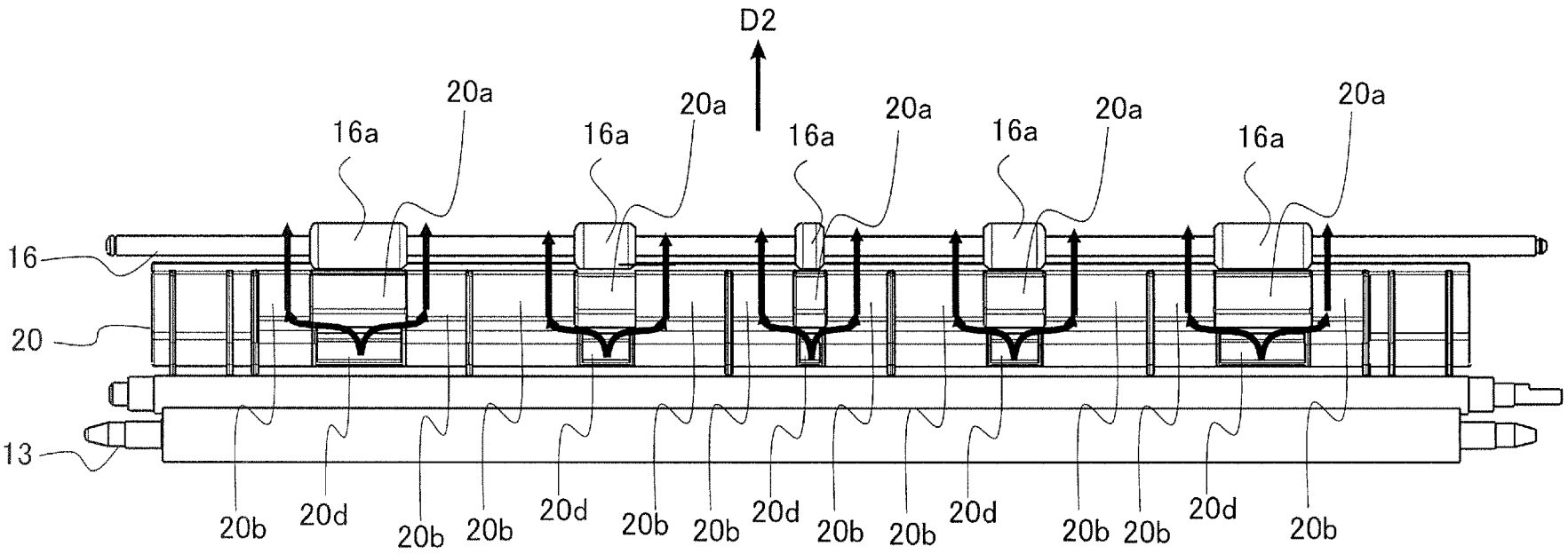
FIG. 4 is a plan view for illustrating flow of cooling air of the first embodiment.

FIGS. 2A to 4 illustrate a configuration of the decurler roller pair 13, the discharging roller pair 14, and the guide member 20. FIG. 2A is a perspective view illustrating the guide member 20 and its surroundings. FIG. 2B is a side view of the guide member 20 and its surroundings, as viewed from a direction perpendicular to the sheet conveyance direction. FIG. 2C is a cross-sectional view taken along a line A-A of FIG. 2B. FIG. 2D is a cross-sectional view taken along a line B-B of FIG. 2B. FIG. 3A is a partial enlarged view of FIG. 2C. FIG. 3B is a partial enlarged view of FIG. 2D. FIG. 4 is a plan view as viewed from above of FIG. 2B. In FIG. 4, the upper roller 15 of the discharging roller pair 14 is not illustrated.

As illustrated in FIGS. 2A and 2B, each of the decurler roller pair 13 is a columnar roller which has a constant outer diameter over the entire length thereof in a width direction (i.e., direction perpendicular to the sheet conveyance direction, right and left direction in FIG. 2B). Thus, the decurler roller pair 13 hardly causes a difference in cooling effect on the toner image, from position to position in the width direction.

The discharging roller pair 14 includes the lower roller 16 which contacts the first sheet surface and serves as a first roller, and the upper roller 15 which contacts the second sheet surface and serves as a second roller. The upper roller 15 includes a plurality of roller bodies 15*a* disposed along the axis of the upper roller 15, and the lower roller 16 includes a plurality of roller bodies 16*a* disposed along the axis of the lower roller 16. The plurality of roller bodies 16*a* are a plurality of first rotary members of the present embodiment, and the plurality of roller bodies 15*a* are a plurality of second rotary members of the present embodiment. Each of the roller bodies 15*a* and 16*a* has an outer circumferential surface which comes in contact with the sheet S. The outer circumferential surface is typically made of material, such as rubber, which hardly slips on the sheet S. The roller bodies 15*a* of the upper roller 15 and the roller bodies 16*a* of the lower roller 16 are shifted from each other in the axial direction, and overlap with each other when viewed in the axial direction. Thus, the roller bodies 15*a* and 16*a* may be called comb-teeth rollers. This arrangement can increase stiffness of the sheet S by causing the sheet S to become wavy, and thus is advantageous when a large size of sheet S will be stacked on the sheet stacking portion 17.

The guide member 20, which is a conveyance guide of the present embodiment, is disposed between the decurler roller pair 13 and the discharging roller pair 14, faces the first sheet surface of the sheet S, and guides the sheet S toward the discharging roller pair 14. As illustrated in FIG. 1B, the guide member 20 and a facing guide 23 which faces the second sheet surface of the sheet S form a sheet conveyance path extending from the decurler roller pair 13 to the discharging roller pair 14. The guide member 20 is fixed to a frame of the printer body 1A.

As illustrated in FIGS. 2A and 2B, the air outlets 20*d* of the guide member 20 are disposed in the width direction, at a plurality of positions respectively corresponding to the roller bodies 16*a* of the lower roller 16. That is, a location in the width direction of each of the air outlets 20*d* and a location in the width direction of a corresponding one among the roller bodies 16*a* at least partially overlap with each other.

The guide member 20 includes first bottom portions 20*a* and second bottom portions 20*b*, which are formed between the air outlets 20*d* and the discharging roller pair 14 in the sheet conveyance direction. The first bottom portions 20*a* are disposed at a plurality of positions in the width direction respectively corresponding to the roller bodies 16*a* of the lower roller 16 (FIG. 2B). The second bottom portions 20*b* are disposed at a plurality of positions in the width direction, alternately with the first bottom portions 20*a*. That is, two of the second bottom portions 20*b* are disposed on both sides of each of the first bottom portions 20*a* in the width direction. The first bottom portions 20*a* are first surface parts of the conveyance guide of the present embodiment, and the second bottom portions 20*b* are second surface parts of the conveyance guide of the present embodiment.

As illustrated in FIGS. 2C and 2D, the first bottom portions 20*a* and the second bottom portions 20*b* are different from each other in position in a thickness direction of the sheet S, and the first bottom portions 20*a* protrude toward the sheet S with respect to the second bottom portions 20*b*.

Here, shapes of the first bottom portions 20*a* and the second bottom portions 20*b* will be described with reference to FIGS. 3A and 3B. Hereinafter, to describe the heights of the first bottom portions 20*a* and the second bottom portions 20*b*, a height direction D1 is defined. Specifically, in a cross section (FIGS. 3A and 3B) as viewed from the width direction, the height direction D1 is defined as a direction along a line drawn from an axis O1 of the lower roller 16 toward an axis O2 of the upper roller 15. In addition, in the cross section, a sheet conveyance direction D2 of the discharging roller pair 14 is defined as a direction perpendicular to the height direction D1.

As illustrated in FIG. 3A, the first bottom portion 20*a* is inclined with respect to the sheet conveyance direction D2 such that the first bottom portion 20*a* protrudes further in the height direction D1 as the first bottom portion 20*a* extends further downstream in the sheet conveyance direction D2. Specifically, at positions P1, P2, and P3 positioned along a line extending downstream of the air outlet 20*d*, gaps L11, L12, and L13 between the sheet S, which is being conveyed, and the first bottom portion 20*a* are formed and become smaller in this order. Thus, at the position P3 positioned most downstream in the sheet conveyance direction D2, the gap between the first bottom portion 20*a* and the sheet S becomes minimum.

On the other hand, as illustrated in FIG. 3B, the second bottom portion 20*b* is shaped such that, at the position positioned most downstream in the sheet conveyance direction D2, the gap between the second bottom portion 20*b* and the sheet S, which is being conveyed, is larger than the gap between the first bottom portion 20*a* and the sheet S. The second bottom portion 20*b* is arranged to be more distant from the sheet S in the height direction D1 than the first bottom portion 20*a*, in at least one part of a section between the air outlet 20*d* and the discharging roller pair 14 in the sheet conveyance direction D2. Specifically, the first bottom portion 20*a* is inclined with respect to the second bottom portion 20*b* such that as the first bottom portion 20*a* extends downstream in the sheet conveyance direction D2, the amount (h) of protrusion of the first bottom portion 20*a* with respect to the second bottom portion 20*b* becomes larger. In this structure, at the positions P1, P2, and P3 illustrated in FIG. 3A and positioned along the sheet conveyance direction D2, gaps between the second bottom portion 20*b* and the sheet S, which is being conveyed, are L21, L22, and L23, and the gap L21 is almost equal to the gap L11, whereas the gap L22 is larger than the gap L12, and the gap L23 is larger than the gap L13.

Next, how the first bottom portion 20*a* and the second bottom portion 20*b* guide the cooling air will be described with reference to FIG. 4. The air flow from the fan 21 is blown to the first sheet surface of the sheet S, through the air outlet 20*d*. As illustrated in FIG. 4, at least one part of the air flow having blown on the sheet S flows downstream in the sheet conveyance direction D2, through the gap between the first bottom portion 20*a* and the sheet S.

As described above, the gap between the first bottom portion 20*a* and the sheet S decreases as the first bottom portion 20*a* extends downstream in the sheet conveyance direction D2. However, the gap between the second bottom portion 20*b*, adjacent to the first bottom portion 20*a* in the width direction, and the sheet S is larger than the gap between the first bottom portion 20*a* and the sheet S. As a result, the cooling air flows through the gap between the first bottom portion 20*a* and the sheet S, splits toward both sides, in the width direction, of the first bottom portion 20*a*, flows through the gap between the second bottom portion 20*b* and the sheet S, and then passes the lower roller 16 of the discharging roller pair 14 in the sheet conveyance direction D2. In other words, the air flow from the air outlet 20*d* cools the first sheet surface of the sheet S on an area in the width direction which corresponds to a location in the width direction where the roller body 16*a* is provided, and is then guided toward the outside of the roller body 16*a* in the width direction.

As described above, in the present embodiment, a location in the width direction of each first bottom portion 20*a* overlap with a location in the width direction of the corresponding roller body 16*a* to be in contact with the printing surface of the sheet S; and protrudes in the height direction D1 with respect to the second bottom portion 20*b*, in a section between the air outlet 20*d* and the roller body 16*a*. In other words, a position of the first surface part overlaps with a position of the first rotary member in terms of the width direction; and protrudes in the height direction with respect to the second surface part, in at least one part of a section between the opening and the first rotary member in the sheet conveyance direction. With this configuration, cooling of the first rotary member by the cooling air from the opening is attenuated, and the difference in temperature between the sheet and the first rotary member can be reduced. Consequently, the unevenness in gloss on the toner image on the first sheet surface, caused by the roller mark of the first rotary member, can be reduced.

In particular, in the present embodiment, the plurality of air outlets 20*d* are disposed at positions in the width direction corresponding to the roller bodies 16*a*. That is, one air outlet 20*d*, one first bottom portion 20*a*, and one roller body 16*a* constitute one unit configuration (one set), and the unit configurations are disposed alternately with the second bottom portions 20*b* in the width direction. Thus, a portion of the first sheet surface of the sheet S which will contact the roller body 16*a* is efficiently cooled by the fresh cooling air from the air outlet 20*d*. Then the portion of the first sheet surface of the sheet S passes the space above the first bottom portion 20*a*, and the roller body 16*a*. With this configuration, the difference in temperature between the portion of the sheet S, which will contact the roller body 16*a*, and the roller body 16*a* can be reduced, and the roller mark can be more effectively suppressed.

Accordingly, it is preferable that the air outlet 20*d*, the first bottom portion 20*a*, and the roller body 16*a* are arranged on accurately corresponding positions in the width direction. Preferably, the air outlet 20*d*, the first bottom portion 20*a*, and the roller body 16*a* are disposed such that a plane (e.g., A-A cross section of FIG. 2B) perpendicular to the width direction crosses a middle position in the width direction of each roller body 16*a*, each air outlet 20*d*, and each first bottom portion 20*a*. In addition, it is preferable that the length of the first bottom portion 20*a* in the width direction is equal to or larger than the length of an outer circumferential surface (a surface having the largest outer diameter) of the roller body 16*a* in the width direction.

On both edge portions of each of the air outlets 20*d* in the width direction, ribs 20*c* (i.e., first ribs in the present embodiment) are formed along the sheet conveyance direction D2 (see FIGS. 2A and 3A). The ribs 20*c* guide the fresh cooling air, flowing out of the air outlet 20*d*, toward a portion of the first sheet surface, which corresponds to a location of the roller body 16*a* in the width direction; and thereby causing the cooling air to efficiently cool the portion. Here, the first bottom portion 20*a* protrudes with respect to the second bottom portion 20*b* at positions (P2, P3) positioned downstream of the ribs 20*c* in the sheet conveyance direction D2 (see FIGS. 3A and 3B). With this arrangement, the cooling air having blown to the sheet S and flowed toward the sheet conveyance direction D2 can be smoothly guided from the first bottom portion 20*a* to the second bottom portion 20*b*, without being blocked by the ribs 20*c*.

In addition, the guide member 20 includes a plurality of ribs 20*f* (i.e., second ribs in the present embodiment), each disposed along the air outlet 20*d* and the first bottom portion 20*a* in the sheet conveyance direction D2. The ribs 20*f* protrude higher in the height direction D1 than the first bottom portion 20*a* and the second bottom portion 20*b*, or at least have the same height (FIGS. 3A and 3B) as the higher one among the first and second bottom portions 20*a* and 20*b* at each position in the sheet conveyance direction. Similar to the first bottom portion 20*a*, the ribs 20*f* have a height at which the ribs 20*f* do not contact the sheet S. The ribs 20*f* are disposed on the second bottom portions 20*b* in the width direction, and each of the ribs 20*f* is separated from adjacent first bottom portions 20*a*, 20*a* in the width direction. That is, each of the ribs 20*f* is arranged so as not to obstruct the air flow from the first bottom portion 20*a* toward the second bottom portion 20*b*.

Figure 5:
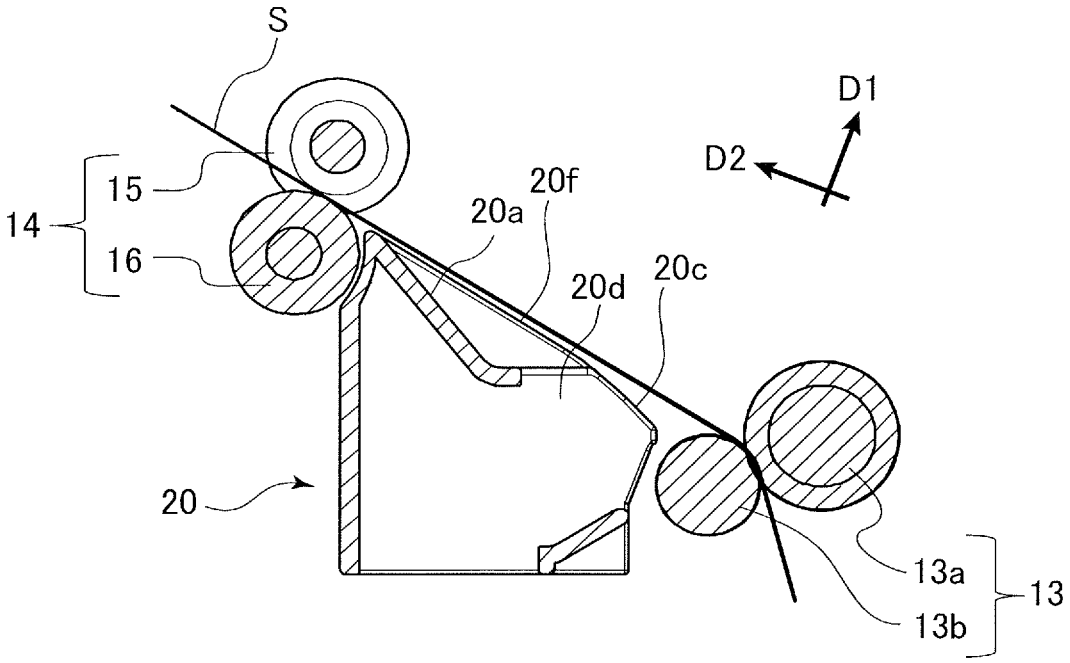
FIG. 5 is a cross-sectional view for illustrating a shape of the guide member of the first embodiment.

Here, as illustrated in FIG. 5, even when the sheet S is stretched tightly between the discharging roller pair 14 and the decurler roller pair 13, the first bottom portion 20*a* has a height at which the first bottom portion 20*a* does not contact the sheet S. In other words, the first bottom portion 20*a* is retracted in the height direction D1 from the rib 20*f*, which serves as a contact surface of the guide member 20 that will be in contact with the sheet S. With this arrangement, even though the first bottom portion 20*a* protrudes with respect to the second bottom portion 20*b*, the first bottom portion 20*a* can be prevented from contacting the sheet S and causing an image defect. Here, the decurler roller pair 13 is one example of upstream conveyance units.

Thus, when the sheet S sent from the fixing apparatus 100 is directly delivered to the discharging roller pair 14, the fixing apparatus 100 serves as an upstream conveyance unit.

Second Embodiment

Figure 6A:
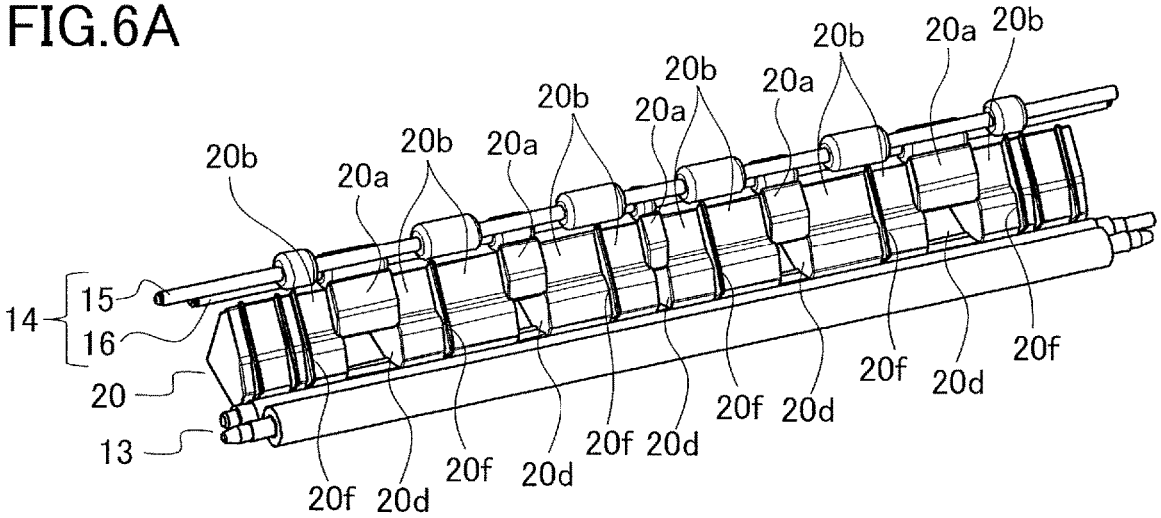
FIG. 6A is a perspective view illustrating a guide member and its surroundings of a second embodiment.
Figure 6B:
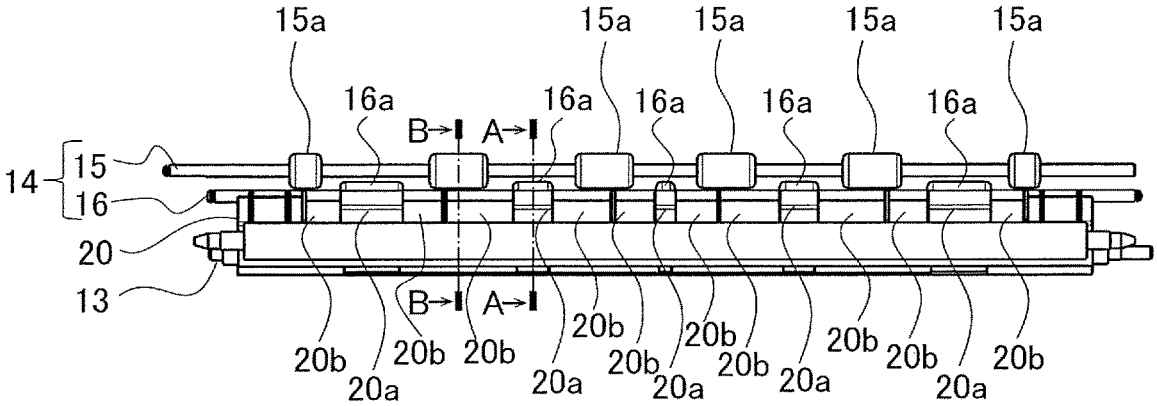
FIG. 6B is a side view illustrating the guide member and its surroundings of the second embodiment.
Figure 6C:
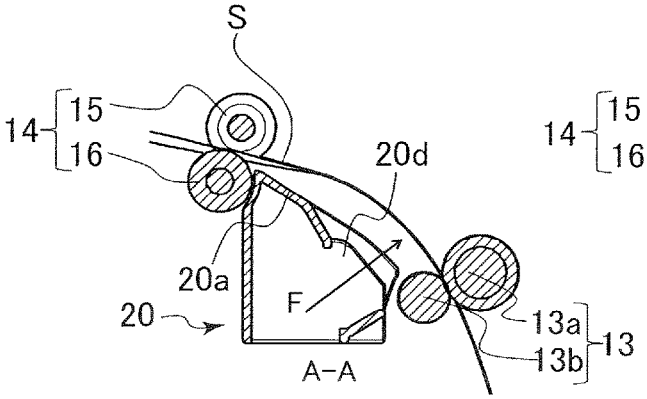
FIG. 6C is a cross-sectional view illustrating the guide member and its surroundings of the second embodiment.
Figure 6D:
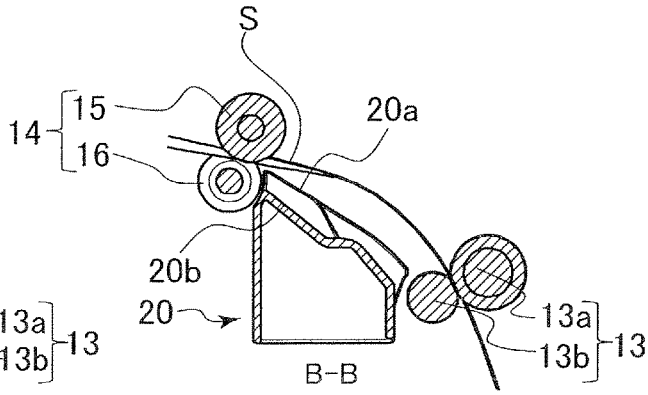
FIG. 6D is a cross-sectional view illustrating the guide member and its surroundings of the second embodiment.
Figure 7A:
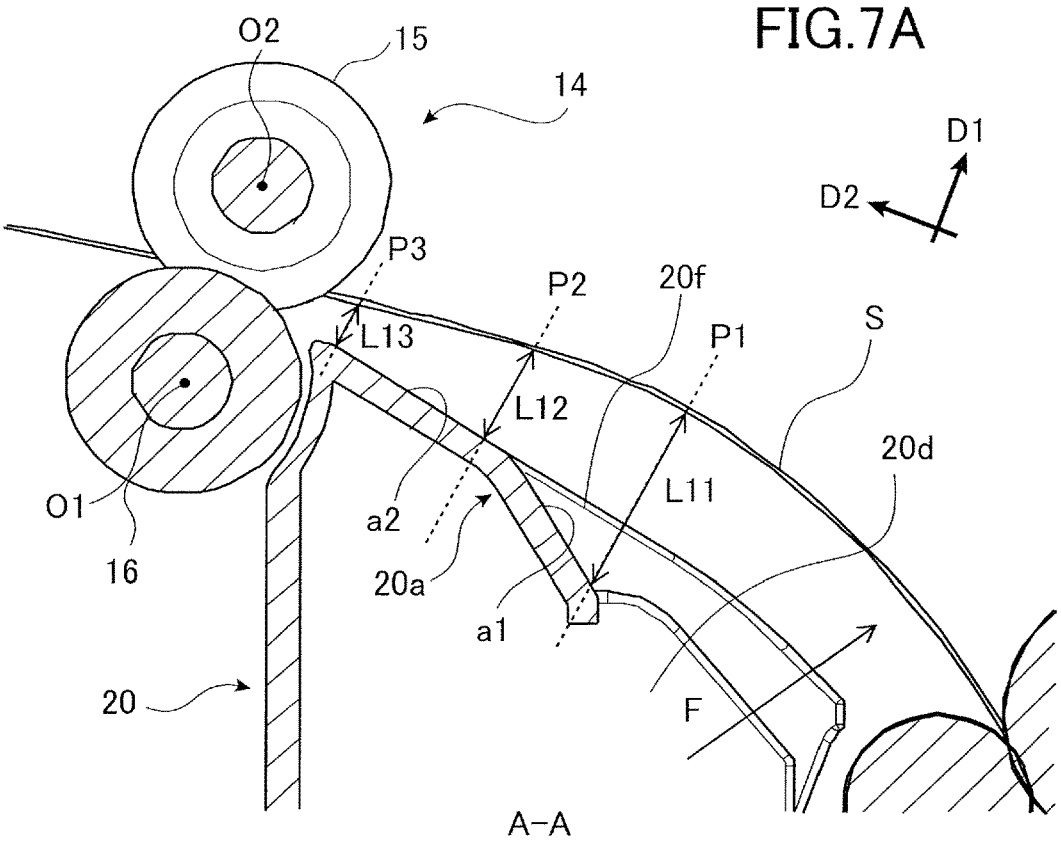
FIG. 7A is an enlarged cross-sectional view illustrating the guide member and its surroundings of the second embodiment.
Figure 7B:
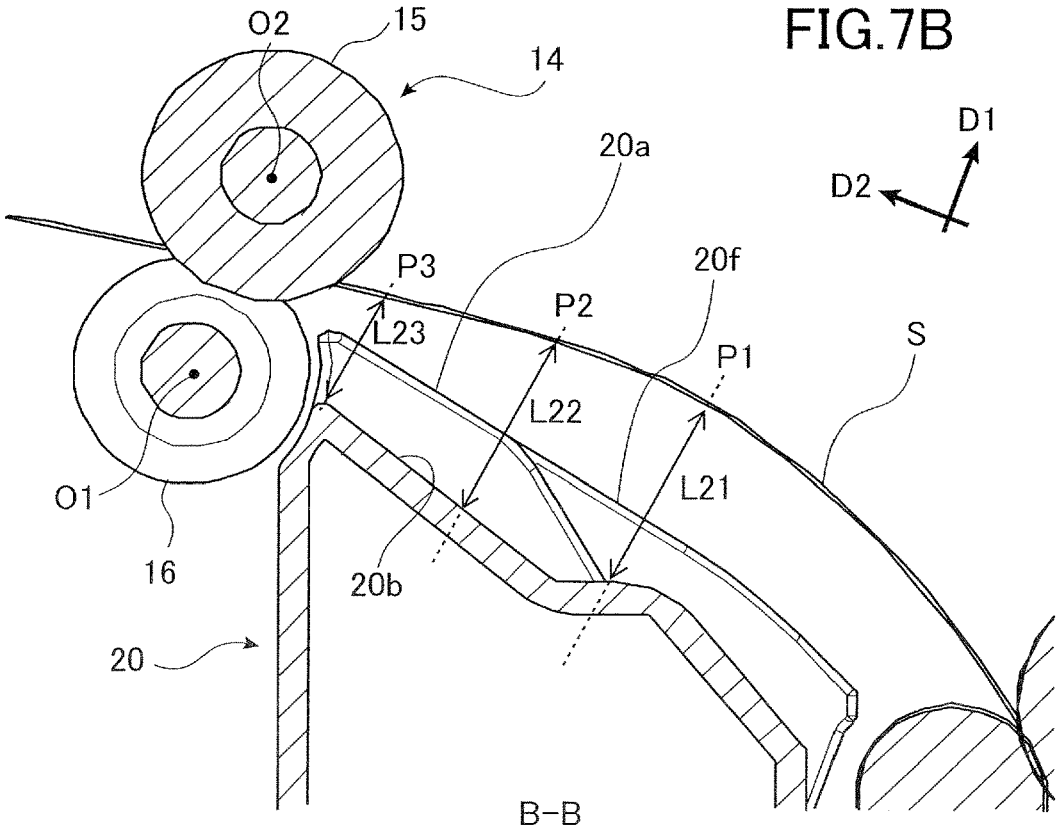
FIG. 7B is an enlarged cross-sectional view illustrating the guide member and its surroundings of the second embodiment.
Figure 8:
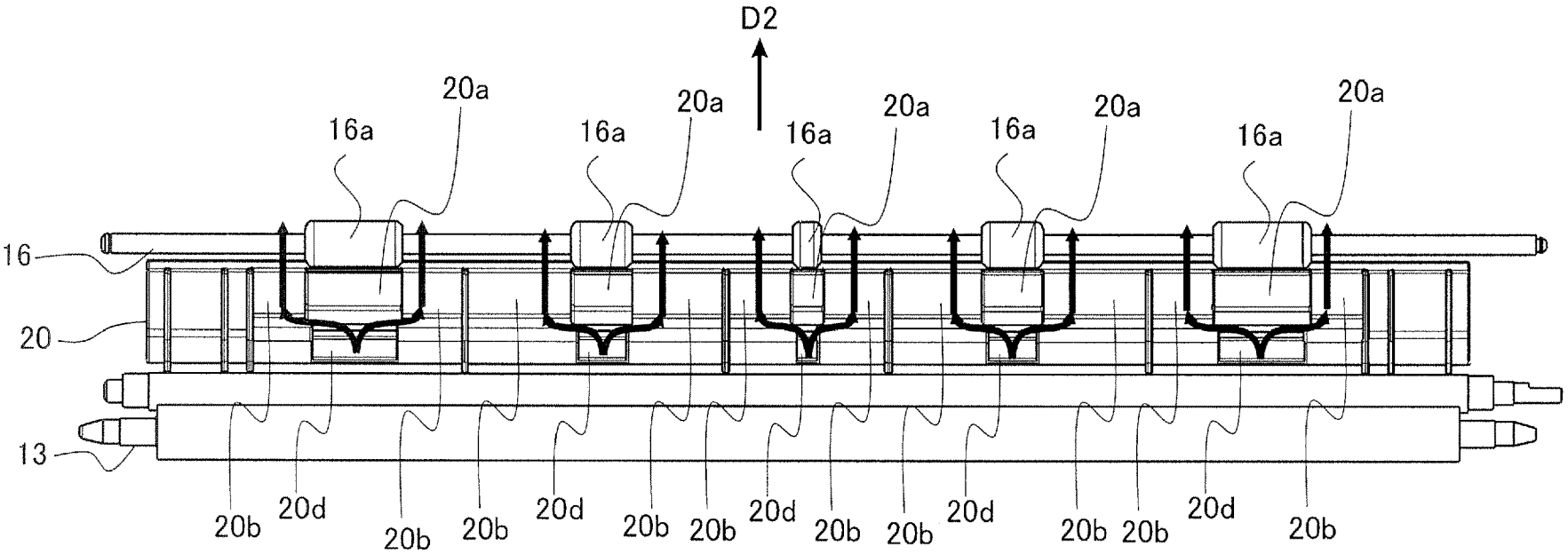
FIG. 8 is a plan view for illustrating flow of cooling air of the second embodiment.

Next, an image forming apparatus of a second embodiment will be described. FIGS. 6A to 9 illustrate a configuration of the decurler roller pair 13, the discharging roller pair 14, and the guide member 20 of the present embodiment. FIG. 6A is a perspective view illustrating the guide member 20 and its surroundings. FIG. 6B is a side view of the guide member 20 and its surroundings, as viewed from a direction perpendicular to the sheet conveyance direction. FIG. 6C is a cross-sectional view taken along a line A-A of FIG. 6B. FIG. 6D is a cross-sectional view taken along a line B-B of FIG. 6B. FIG. 7A is a partial enlarged view of FIG. 6C. FIG. 7B is a partial enlarged view of FIG. 6D. FIG. 8 is a plan view as viewed from above of FIG. 6B. In FIG. 8, the upper roller 15 of the discharging roller pair 14 is not illustrated.

In the present embodiment, the shape of the first bottom portions 20*a* differs from that of the first embodiment, and the ribs 20*c* of the first embodiment are not formed. Hereinafter, a component substantially identical to that of the first embodiment is given an identical symbol, and the description thereof is omitted.

As illustrated in FIGS. 6A to 6D, the guide member 20 includes the first bottom portions 20*a*, the second bottom portions 20*b*, and the ribs 20*f*. The first bottom portions 20*a* are disposed alternately with the second bottom portions 20*b* in the width direction, and overlap with the roller bodies 16*a* of the lower roller 16 of the discharging roller pair 14 in terms of their locations in the width direction. The first bottom portions 20*a* protrude in the height direction with respect to the second bottom portions 20*b*, in a section between the air outlets 20*d* and the roller bodies 16*a*.

As illustrated in FIGS. 7A and 7B, each of the first bottom portions 20*a* of the present embodiment has a first portion a1 formed on an upstream part thereof in the sheet conveyance direction D2 and a second portion a2 formed on a downstream part thereof in the sheet conveyance direction D2, and the upstream first portion a1 and the downstream second portion a2 have angles different from each other. The upstream first portion a1 protrudes more in the height direction D1 as the upstream first portion a1 extends downstream in the sheet conveyance direction D2. The downstream second portion a2 extends along the sheet conveyance direction D2, and is inclined with respect to the upstream first portion a1.

As illustrated in FIG. 7A, the gap between the first bottom portion 20*a* and the sheet S decreases as the first bottom portion 20*a* extends downstream in the sheet conveyance direction D2 from the air outlet 20*d* (L13<L11). Since the first bottom portion 20*a* protrudes in the height direction D1 with respect to the second bottom portion 20*b*, there is a portion of the gap in which a gap between the first bottom portion 20*a* and the sheet S is smaller than a gap between the second bottom portion 20*b* and the sheet S at a common position in the sheet conveyance direction D2. In the example illustrated in FIGS. 7A and 7B, a gap L12 between the first bottom portion 20*a* and the sheet S at the position P2 positioned downstream in the sheet conveyance direction D2 is smaller than a gap L22 between the second bottom portion 20*b* and the sheet S at the position P2, and a gap L13 between the first bottom portion 20*a* and the sheet S at the position P3 positioned downstream in the sheet conveyance direction D2 is smaller than a gap L23 between the second bottom portion 20*b* and the sheet S at the position P3.

Figure 9:
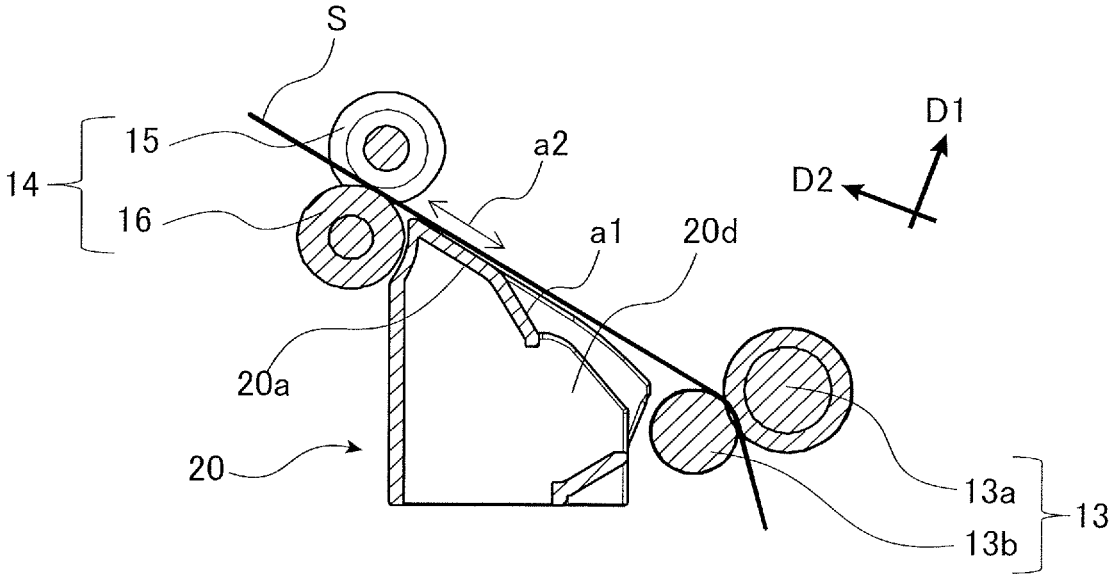
FIG. 9 is a cross-sectional view for illustrating a shape of the guide member of the second embodiment.

The second portion a2 is disposed at substantially the same position as that of the top edge of the rib 20*f* in the height direction D1. Thus, as illustrated in FIG. 9, when the sheet S is stretched tightly between the decurler roller pair 13 and the discharging roller pair 14, the second portion a2 is substantially parallel to the sheet S as viewed from the width direction.

As illustrated in FIG. 8, the cooling air from the air outlet 20*d* is blown to the first sheet surface of the sheet S, and flows downstream in the sheet conveyance direction D2. Here, the gap between the first portion a1 of the first bottom portion 20*a* and the sheet S decreases as the first portion a1 extends downstream in the sheet conveyance direction D2, whereas the gap between the second bottom portion 20*b* adjacent to the first bottom portion 20*a* in the width direction and the sheet S is larger than the gap between the first bottom portion 20*a* and the sheet S. Consequently, the cooling air flows through the gap between the first bottom portion 20*a* and the sheet S, splits toward both sides in the width direction of the first bottom portion 20*a*, flows through the gap between the second bottom portion 20*b* and the sheet S, and then passes the lower roller 16 of the discharging roller pair 14 in the sheet conveyance direction D2. Thus, as in the first embodiment, the increase in temperature difference between the roller bodies 16*a* and the sheet S, caused by the cooling air, can be prevented; and the roller mark can be suppressed.

In the present embodiment, the downstream portion (second portion a2) of the first bottom portion 20*a* is disposed closer to the sheet S than the first bottom portion 20*a* of the first embodiment. Thus, the section in the sheet conveyance direction D2 in which the cooling air from the air outlet 20*d* cools a portion of the sheet S which will contact the roller body 16*a* is shorter than that of the first embodiment. However, since the cooling air is guided by the first bottom portion 20*a* and the second bottom portion 20*b* so as not to blow to the roller body 16*a*, the increase in temperature difference between the roller body 16*a* and the sheet S, caused by cooling the roller body 16*a*, can be prevented. In addition, in the present embodiment, projections such as the ribs 20*c* of the first embodiment are not formed on edge portions of the air outlet 20*d*. Thus, in a case where the cooling air is required to flow in the width direction earlier than in the first embodiment, the present embodiment can smoothly guide the cooling air to the gap between the second bottom portion 20*b* and the sheet S.

Third Embodiment

Figure 10A:
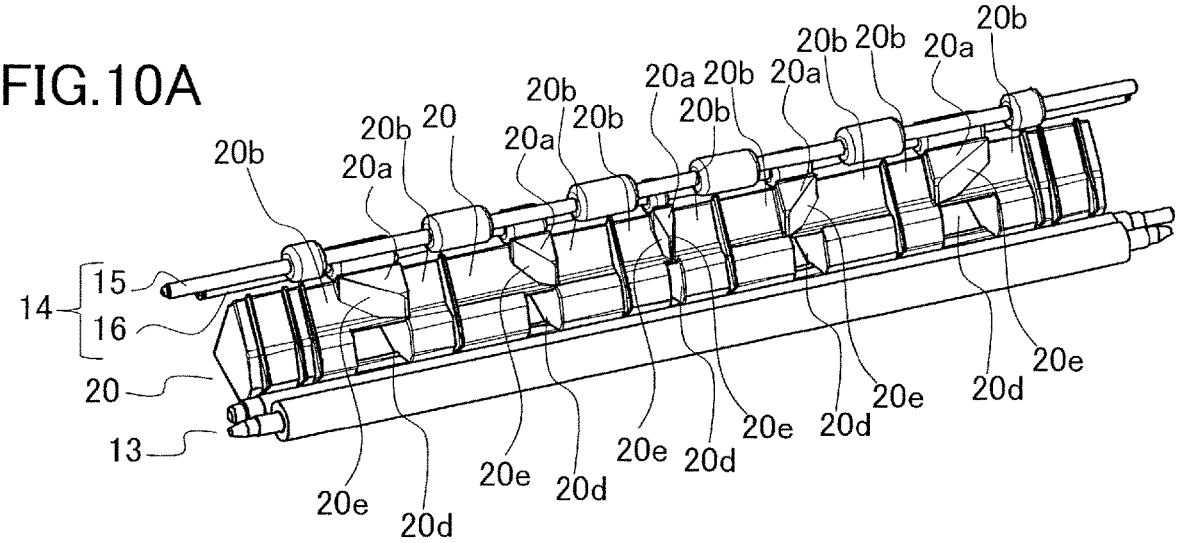
FIG. 10A is a perspective view illustrating a guide member and its surroundings of a third embodiment.
Figure 10B:
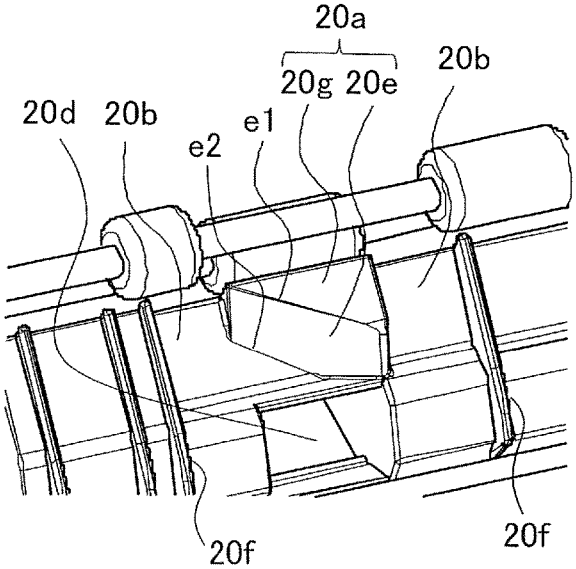
FIG. 10B is an enlarged view of FIG. 10A.
Figure 10C:
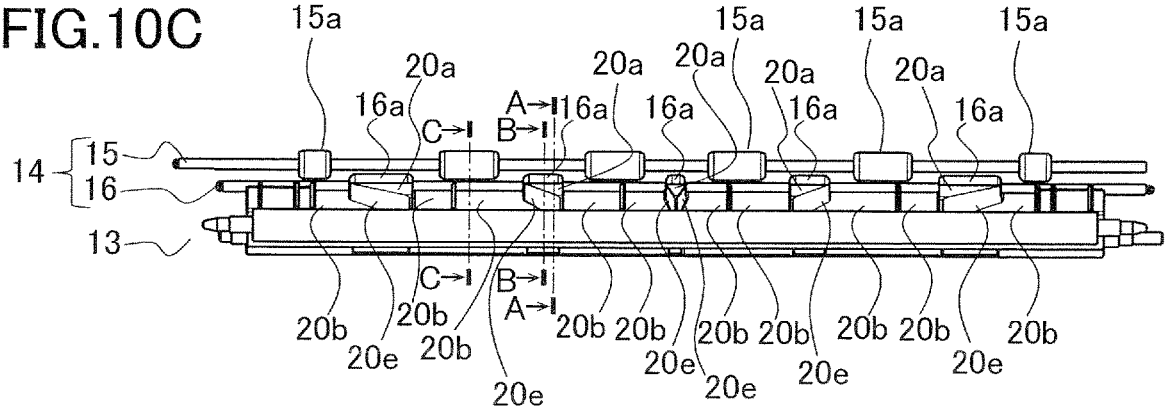
FIG. 10C is a side view illustrating the guide member and its surroundings of the third embodiment.
Figure 11A:
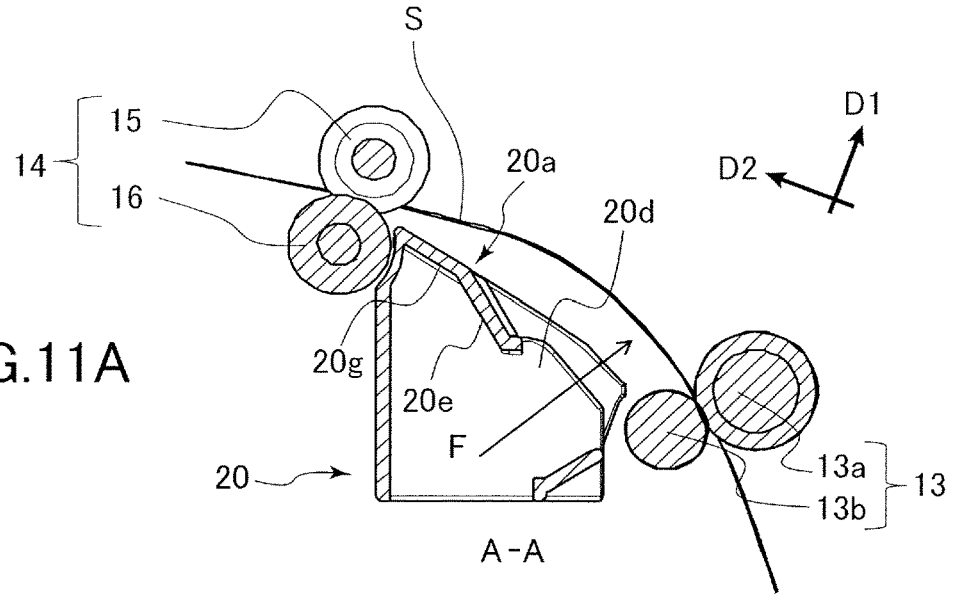
FIG. 11A is a cross-sectional view illustrating the guide member and its surroundings of the third embodiment.
Figure 11B:
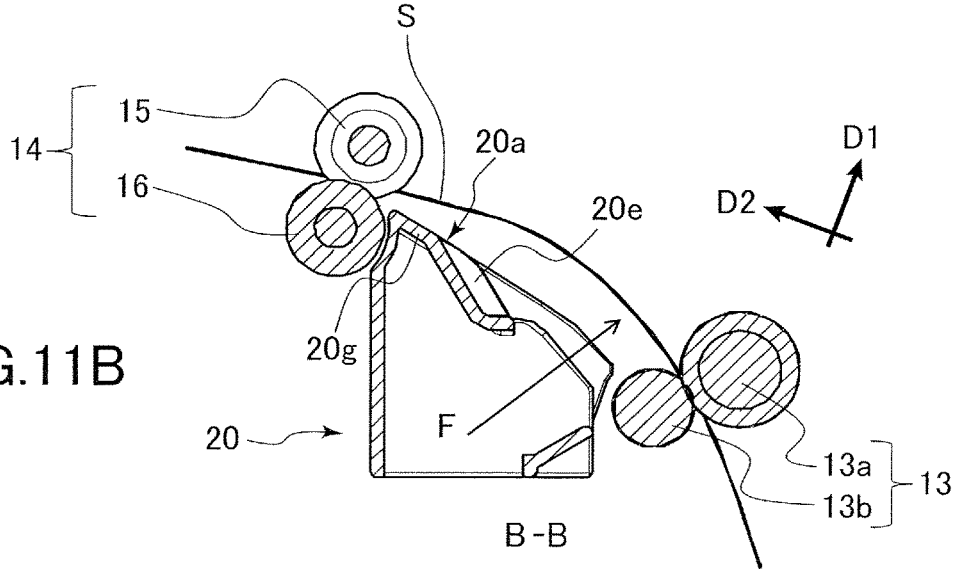
FIG. 11B is a cross-sectional view illustrating the guide member and its surroundings of the third embodiment.
Figure 11C:
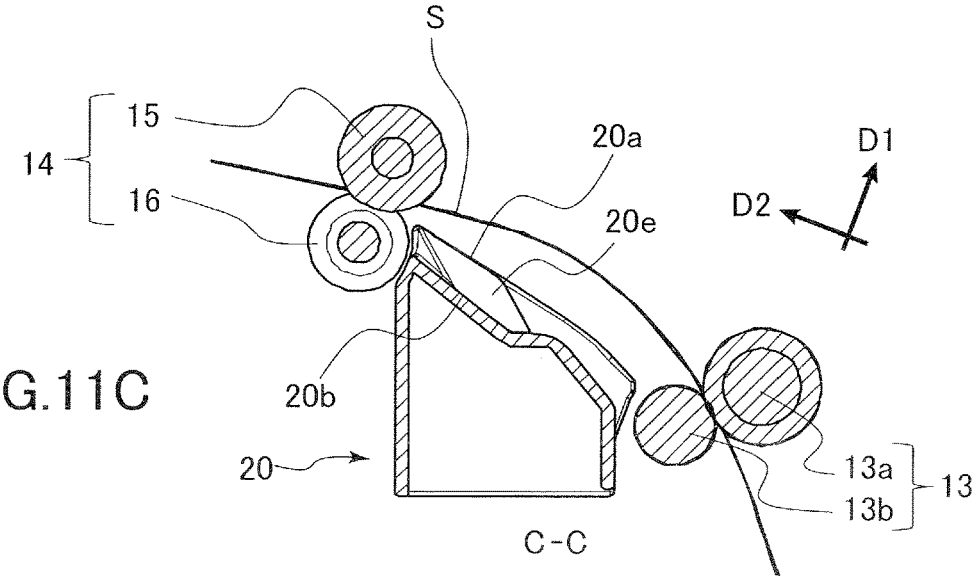
FIG. 11C is a cross-sectional view illustrating the guide member and its surroundings of the third embodiment.
Figure 12A:
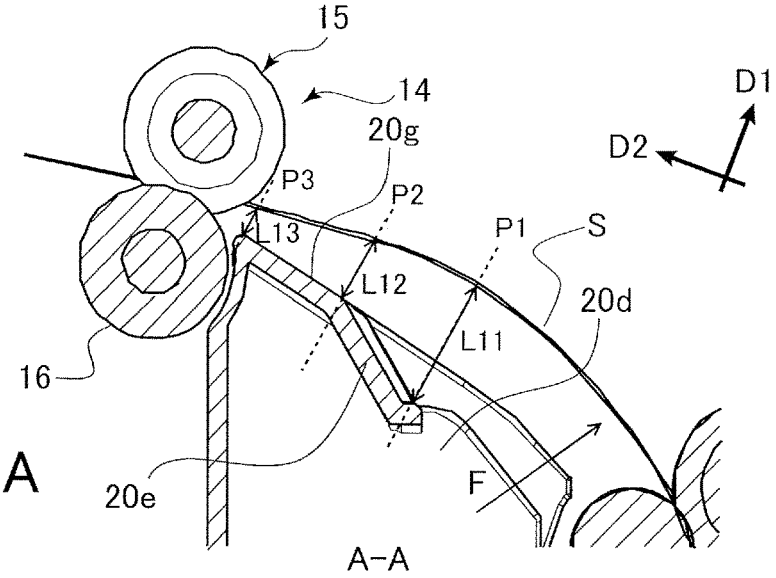
FIG. 12A is an enlarged cross-sectional view illustrating the guide member and its surroundings of the third embodiment.
Figure 12B:
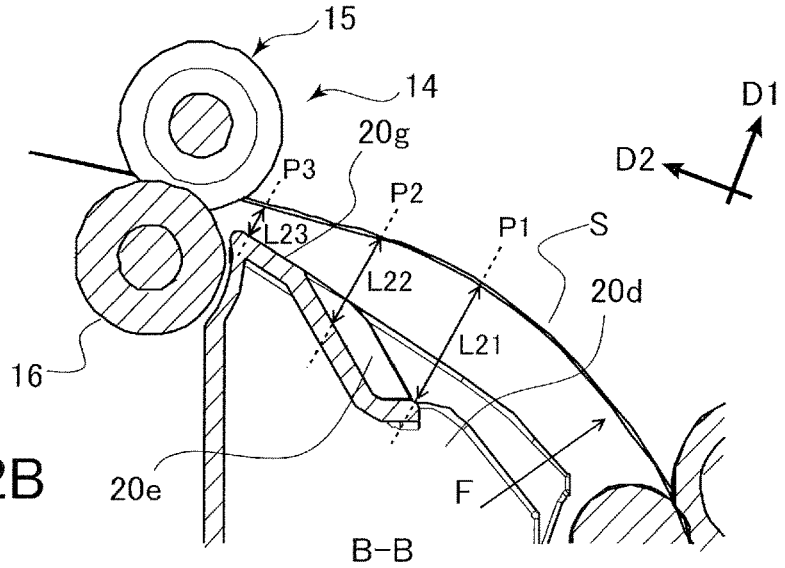
FIG. 12B is an enlarged cross-sectional view illustrating the guide member and its surroundings of the third embodiment.
Figure 12C:
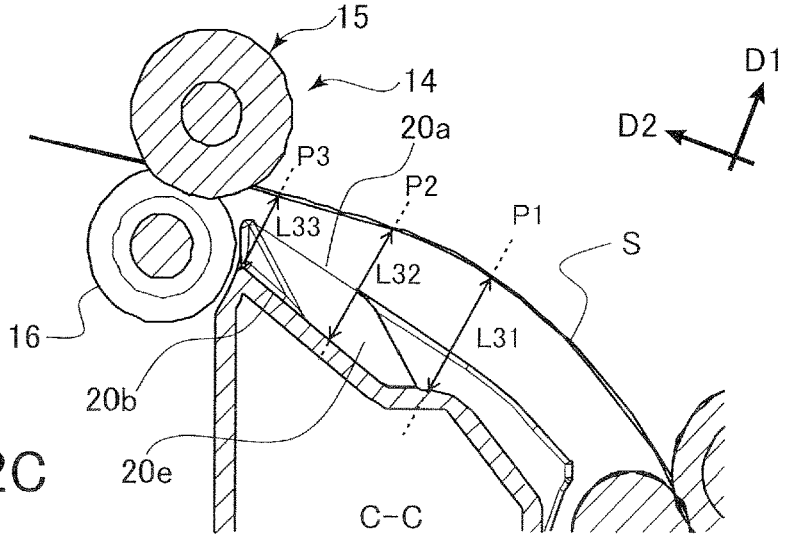
FIG. 12C is an enlarged cross-sectional view illustrating the guide member and its surroundings of the third embodiment.
Figure 13:
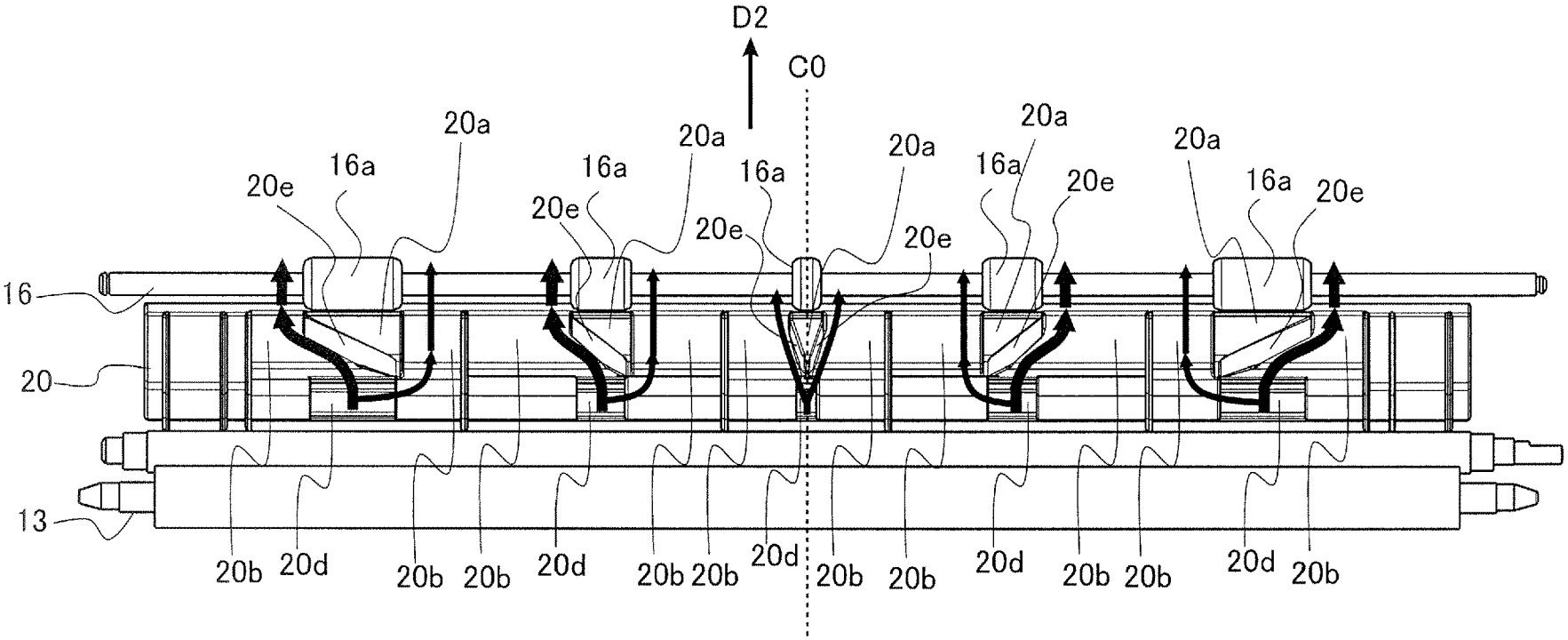
FIG. 13 is a plan view for illustrating flow of cooling air of the third embodiment.

Next, an image forming apparatus of a third embodiment will be described. FIGS. 10A to 13 illustrate a configuration of the decurler roller pair 13, the discharging roller pair 14, and the guide member 20 of the present embodiment. FIG. 10A is a perspective view illustrating the guide member 20 and its surroundings. FIG. 10B is a partial enlarged view of FIG. 10A. FIG. 10C is a side view of the guide member 20 and its surroundings, as viewed from a direction perpendicular to the sheet conveyance direction. FIG. 11A is a cross-sectional view taken along a line A-A of FIG. 10C. FIG. 11B is a cross-sectional view taken along a line B-B of FIG. 10C. FIG. 11C is a cross-sectional view taken along a line C-C of FIG. 10C. FIG. 12A is a partial enlarged view of FIG. 11A. FIG. 12B is a partial enlarged view of FIG. 11B. FIG. 12C is a partial enlarged view of FIG. 11C. FIG. 13 is a plan view as viewed from above of FIG. 10C. In FIG. 13, the upper roller 15 of the discharging roller pair 14 is not illustrated.

In the present embodiment, the shape of the first bottom portions 20*a* differs from that of the second embodiment. Hereinafter, a component substantially identical to that of the second embodiment is given an identical symbol, and the description thereof is omitted.

As illustrated in FIGS. 10A to 10C, the guide member 20 includes the first bottom portions 20*a*, the second bottom portions 20*b*, and the ribs 20*f* The first bottom portions 20*a* are disposed alternately with the second bottom portions 20*b* in the width direction, and overlap with the roller bodies 16*a* of the lower roller 16 of the discharging roller pair 14 in terms of their locations in the width direction. The first bottom portions 20*a* protrude in the height direction D1 with respect to the second bottom portions 20*b*, in a section between the air outlets 20*d* and the roller bodies 16*a*. Thus, also in the present embodiment, the difference in temperature between the roller bodies 16*a* and the sheet S can be reduced, as in the first and the second embodiments, by suppressing the cooling air from cooling the roller bodies 16; and the roller mark can be suppressed from occurring.

As illustrated in FIG. 10B, the first bottom portion 20*a* of the present embodiment includes a protruding portion 20*g* and a joining surface 20*e*. The protruding portion 20*g* protrudes with respect to the second bottom portion 20*b*, and the joining surface 20*e* joins the second bottom portion 20*b* and the protruding portion 20*g*. The joining surface 20*e* is at least inclined with respect to a plane perpendicular to the width direction, so that the joining surface 20*e* guides the cooling air, which would otherwise flow downstream in the sheet conveyance direction D2, toward either side in the width direction. In other words, the joining surface 20*e* is formed such that the normal vector of the joining surface 20*e* has a component in the width direction.

Specifically, the joining surface 20*e* has a first joining portion e1 and a second joining portion e2, and the first joining portion e1 and the second joining portion e2 extend further outward in the width direction with respect to a center line of conveyance as they extend downstream in the sheet conveyance direction. Here, the first joining portion e1 is a boundary between the first bottom portion 20*a* and the joining surface 20*e*, and the second joining portion e2 is a boundary between the second bottom portion 20*b* and the joining surface 20*e*. The center line of conveyance is located at the middle position in the width direction of an area where the sheet S being conveyed by the discharging roller pair 14 pass through. In the configuration of the present embodiment in which the plurality of roller bodies 16*a* are symmetrically disposed in the width direction, the center line of conveyance is a symmetry axis CO of the plurality of roller bodies 16*a* (see FIG. 13).

As illustrated in FIGS. 11A to 12C, in a cross section as viewed from the width direction, the joining surface 20*e* protrudes more in the height direction D1 as the joining surface 20*e* extends downstream in the sheet conveyance direction D2. The protruding portion 20*g* of the first bottom portion 20*a* extends along the sheet conveyance direction D2, and is inclined with respect to the joining surface 20*e*. That is, the protruding portion 20*g* and the joining surface 20*e* of the present embodiment are other examples of the upstream first portion and the downstream second portion formed in the sheet conveyance direction D2.

As illustrated in FIGS. 12A and 12B, the gap between the first bottom portion 20*a* and the sheet S decreases as the first bottom portion 20*a* extends downstream in the sheet conveyance direction D2 from the air outlet 20*d* (L13<L11, L23<L21 and L33<L31). Since the protruding portion 20*g* of the first bottom portion 20*a* protrudes in the height direction D1 with respect to the second bottom portion 20*b*, if a gap L13 between the first bottom portion 20*a* and the sheet S, a gap L23 between the first bottom portion 20*a* and the sheet S, and a gap L33 between the second bottom portion 20*b* and the sheet S are obtained at a common position in the sheet conveyance direction D2, the gaps L13 and L23 are smaller than the gap L33.

In addition, since the joining surface 20*e* of the present embodiment is inclined as described above, a position of the joining surface 20*e* on a plane perpendicular to the width direction changes depending on the position of the plane. For example, at a position P2 (included in an area where the joining surface 20*e* is disposed) in the sheet conveyance direction D2, the gap between the first bottom portion 20*a* or the second bottom portion 20*b* and the sheet S increases as the joining surface 20*e* extends outward in the width direction (L12<L22<L32).

As illustrated in FIG. 13, the cooling air from the air outlet 20*d*, which has blown to the sheet and flowed in the sheet conveyance direction D2, is guided by the joining surface 20*e* mainly outward in the width direction. With this operation, the difference in temperature between the sheet S and the roller bodies 16*a* can be reduced. In particular, the present embodiment controls the direction in which the cooling air flows, by changing the angle of the joining surface 20*e*. Thus, even in a case where the air outlets 20*d* are disposed in an area whose width is smaller than the maximum width of images that the printer 1 can form, the joining surface 20*e* that distributes the cooling air toward the width direction can efficiently cool the entire sheet S.

Other Embodiments

In the first to the third embodiments, the sheet S on which the toner image has been formed and which has been heated by the fixing apparatus 100 is cooled in a path through which the sheet S is discharged to the outside of the printer body 1A. However, the sheet S may be cooled when delivered from the apparatus body of the image forming apparatus to a sheet processing apparatus connected to the apparatus body. In this case, the apparatus body may blow air flow in the apparatus body to cool the sheet S, or the sheet processing apparatus may cool the sheet S in the sheet processing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-060697, filed on Mar. 27, 2018, which is hereby incorporated by reference herein in its entirety.

What is claimed is:

1. An image forming apparatus comprising:

a toner image forming portion configured to form a toner image on a sheet;

a heating unit configured to heat the toner image that is formed on the sheet by the toner image forming portion;

a conveyance unit configured to convey the sheet with the toner image that is formed on a first sheet surface of the sheet by the toner image forming portion and is heated by the heating unit, the conveyance unit comprising a first rotary member configured to contact the first sheet surface of the sheet and a second rotary member configured to contact a second sheet surface of the sheet opposite to the first sheet surface;

a conveyance guide configured to face the first sheet surface of the sheet and guide the sheet toward the conveyance unit, the conveyance guide being provided with an opening located between the heating unit and the conveyance unit in a sheet conveyance direction; and an air blower configured to blow air to the first sheet surface of the sheet through the opening, wherein the conveyance guide comprises a first surface part and a second surface part, the first surface part being disposed on a location in a width direction overlapping with a location in the width direction of the first rotary member, the width direction being perpendicular to the sheet conveyance direction, the second surface part being disposed adjacent to the first surface part in the width direction, and wherein in at least a part of a range between the opening and the first rotary member in the sheet conveyance direction, the first surface part is protruded with respect to the second surface part in a height direction, the height direction being a direction along a line drawn from an axis of the first rotary member toward an axis of the second rotary member in a cross section perpendicular to the width direction.

2. The image forming apparatus according to claim 1, wherein the first rotary member is one of a plurality of first rotary members disposed at a plurality of positions in the width direction, and wherein the first surface part is one of a plurality of first surface parts disposed at a plurality of positions in the width direction respectively corresponding to the plurality of first rotary members.

3. The image forming apparatus according to claim 2, wherein the opening is one of a plurality of openings disposed at a plurality of positions in the width direction respectively corresponding to the plurality of first rotary members, wherein each of the plurality of first rotary members comprises an outer circumferential surface configured to come in contact with the sheet, a middle position of the outer circumferential surface in the width direction being located within a range in the width direction where a corresponding one among the plurality of first surface parts is provided, and within a range in the width direction where a corresponding one among the plurality of openings is provided.

4. The image forming apparatus according to claim 3, wherein the second surface part is one of a plurality of second surface parts disposed alternately with the plurality of first surface parts at a plurality of positions in the width direction, wherein a plurality of sets each including one of the plurality of first rotary members, one of the plurality of first surface parts, and one of the plurality of openings are disposed alternately with the plurality of second surface parts in the width direction.

5. The image forming apparatus according to claim 1, wherein an amount of projection of the first surface part in the height direction with respect to the second surface part reaches a maximum at a downstream end portion of the first surface part in the sheet conveyance direction.

6. The image forming apparatus according to claim 1, wherein the first surface part is inclined with respect to the second surface part such that the first surface part protrudes further in the height direction compared to the second surface part as the first surface part extends further downstream in the sheet conveyance direction.

7. The image forming apparatus according to claim 1, wherein the conveyance guide comprises a first rib disposed on an edge portion of the opening in the width direction and extending in the sheet conveyance direction, and wherein the first surface part protrudes with respect to the second surface part in the height direction at a position downstream of the first rib in the sheet conveyance direction.

8. The image forming apparatus according to claim 1, wherein the conveyance guide comprises a second rib extending along the sheet conveyance direction over a range in the sheet conveyance direction where the first surface part is provided, and wherein the second rib is disposed on the second surface part and separated from the first surface part in the width direction.

9. The image forming apparatus according to claim 8, wherein the second rib protrudes higher than or to a same height as the first surface part in the height direction.

10. The image forming apparatus according to claim 8, wherein a width of the first surface part in the width direction is larger than a width of the second rib in the width direction.

11. The image forming apparatus according to claim 1, further comprising an upstream conveyance unit configured to nip and convey the sheet, wherein the first surface part is disposed such that a gap is formed between the first surface part and the sheet in the height direction in a state where the sheet is tightly stretched between the conveyance unit and the upstream conveyance unit.

12. The image forming apparatus according to claim 1, wherein the first surface part comprises a first portion and a second portion, the second portion being disposed downstream of the first portion in the sheet conveyance direction, and wherein, in a cross section perpendicular to the width direction, the first portion extends in a direction inclined with respect to the second surface part while the second portion extends in the sheet conveyance direction, the first portion protruding further in the height direction compared to the second surface part as the first portion extends further downstream in the sheet conveyance direction.

13. The image forming apparatus according to claim 12, wherein the first portion is inclined with respect to a plane perpendicular to the width direction and is configured to guide air supplied from the opening toward either side in the width direction along with the air flowing downstream in the sheet conveyance direction.

* * * * *